US005367880A

United States Patent [19]

Lee

[11] Patent Number: 5,367,880

[45] Date of Patent: Nov. 29, 1994

[54] DISPLACER APPARATUS OF A SPLIT STIRLING COOLER

[76] Inventor: Woo H. Lee, Jokong Apt. 323-802, Chang-dong, Dobong-ku, Rep. of Korea

[21] Appl. No.: 100,216

[22] Filed: Aug. 2, 1993

[51] Int. Cl.[5] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,834,172 | 9/1974 | Dehne | 62/6 |
| 3,937,018 | 2/1976 | Beale | 62/6 |
| 4,397,156 | 8/1983 | Heisig et al. | 62/6 |
| 4,708,725 | 11/1987 | Okumura | 62/6 |
| 5,003,777 | 4/1991 | Berchowitz | 60/520 |

*Primary Examiner*—Ronald C. Capossela

*Attorney, Agent, or Firm*—Fish & Richardson

[57] ABSTRACT

There is disclosed a Stirling cooler comprising a compressor and a displacer apparatus. To prevent undesirable displacement of a displacer due to leakage of working fluid, the displacer apparatus of the present invention comprises a step portion provided at a lower end of a cylinder and formed with a through hole extending through it to permit work and buffer spaces to be in communication with each other and an actuating hole intersecting the through hole; a centering rod having a through hole formed therein and movably placed in the actuating hole of the step portion; a spring disposed rearwardly of the centering rod to apply a biasing force to the centering rod; and a displacer rod connected to the displacer and having a recess which is formed in an outer periphery of the rod and with which a forward tip of the centering rod is brought into contact.

4 Claims, 3 Drawing Sheets

DISPLACER APPARATUS OF A SPLIT STIRLING COOLER

BACKGROUND OF THE INVENTION

1. Field of the Invention

This invention relates to a Stirling cooler comprising a compressor and a displacer apparatus, and more particularly a centering device for centering a displacer of the displacer apparatus, which reciprocates in response to changes in pressure of working fluid depending upon operation of the compressor.

2. Description of the Prior Art

Generally, as shown in FIG. 1 of the accompanying drawings, a Stirling cooler comprises a compressor 10 including a cylinder 12 and a piston 14 reciprocating within the cylinder 12 to effect compressing operation, and a displacer apparatus 20 including a cylinder 21 and a displacer 23 slidably mounted within the cylinder 21 to reciprocate in response to changes in pressure of working fluid depending upon operation of the compressor 10.

The cylinder 12 of the compressor 10 has cooling fins 11 formed on its outer periphery and outlet 19 formed centrally in its top for passage of the working fluid. A crankcase 13 is connected to a lower end of the cylinder 12, and a crankshaft 15 coupled to a drive motor 16 is disposed within the crankcase 13 and connected to the piston 14 via a connecting rod 17. The piston 14 slidably mounted in the cylinder 12 has a piston ring 18 fitted on an outer periphery thereof to be brought into air-tight engagement with the inner periphery of the cylinder 12.

The displacer apparatus 20 further comprises a freezer 22 disposed on the top of the cylinder 21. The cylinder 21 has a step potion 21*a* provided internally of the middle portion thereof and defining a central bore of a reduced diameter, and a hole 21*b* formed in side wall thereof to be connected to the outlet 19 of the compressor 10.

The cylinder 21 of the displacer apparatus 20 comprises an expansion space 24 defined above the displacer 23 reciprocating in the cylinder and a work space 25 defined between the step portion 21*a* and the displacer 23. Thus, the volumes of the expansion and work spaces 24, 25 are variable with the reciprocating movement of the displacer 23. In addition, a buffer spacer 26 effecting a damping function is provided below the step portion 21*a* to be in communication with the work space through the bore of the step portion.

Further, a displacer rod 27 is connected to the lower surface of the displacer 23 and extends downwardly through the central bore provided by the step portion 21*a* of the cylinder 21. A seal ring 28 is fitted on the outer periphery of the middle portion of the displacer rod 27 to function as a seal between the rod and the step portion 21*a*, thereby preventing leakage of the working fluid from the work space 25 into the buffer space 26. In addition, a regenerator 29 effecting a heat exchange function is disposed in the inner hollow space of the displacer 23.

The hole 21*b* formed in the side wall of the cylinder 21 of the displacer apparatus 20 is connected to the outlet 19 of the cylinder 12 of the compressor 10 through a tube 30, which serves as a passage for flow of the working fluid between them.

Operation of the Stirling cooler thus constructed will now be described below.

First, the working fluid is introduced into the respective spaces of the Stirling cooler at the same pressure so that the pressure of the fluid is constant throughout the interior of the cooler. Thus, the fluid in a space provided in the cylinder 12 of the compressor 10 by the piston 14 disposed therein has the same pressure as those in the expansion and work spaces 24, 25 formed above and below the displacer 23 of the displacer apparatus 20.

The buffer space 26 of the displacer apparatus 20, into which one end of the displacer rod 27 is extended, serves as a gas spring when the displacer 23 reciprocates in response to variations in pressure of the working fluid.

Therefore, when the fluid pressure in the compressor 10 varies with the reciprocation of the piston 14 in the cylinder 12, which is effected through the crankshaft 15 and the connecting rod 17 by the operation of the drive motor 16, there correspondingly occur changes in the pressure of the fluid in the expansion and work spaces 24, 25 of the displacer apparatus 20. As a result, the difference between the pressures applied to the upper and lower surfaces of the displacer 23 causes repeated reciprocation of the displacer in the cylinder 21. At this time, a damping action is provided by the pressure of the fluid in the buffer space 26 applied to the lower end of the displacer rod 27.

The reciprocation of the displacer rod 27 leads to variations in pressure of the fluid in the work and buffer spaces 25, 26. Curves of the pressure variations are shown in FIG. 2. As can be seen in the graph, since the degrees of the compression and expansion of the working fluid are increased according to the repeated reciprocation of the working fluid are increased according to the repeated reciprocation of the piston 14 of the compressor 10, the pressure of the working fluid in the work space 25 of the displacer apparatus fluctuates greatly from the initial introduction pressure of the fluid. To the contrary, since the upward and downward movements of the displacer rod 27 cause a small change in the volume of the buffer space 26, the pressure of the fluid in the buffer space 26 fluctuates slightly as compared with the pressure in the work space 25.

Further, during the operation, a curve of the variations in actual pressure of the fluid in the work space 25 in the compression step has a distinctly different configuration from that in the expansion step. As shown in the graph of FIG. 3, the curve in the compression step has a peaked configuration.

In the Stirling cooler having the characteristics as set forth above, as shown in FIG. 1, to prevent leakage of the working fluid from the work space 25 into the buffer space 26, the seal ring 28 is disposed on the outer periphery of the displacer rod 27. However, a sealing arrangement comprising only this simple seal ring 28 fails to perfectly prevent the leakage, but provides slight leakage. Particularly, since the leakage of the working fluid is proportional to a square of the pressure of the fluid, the higher the pressure, the greater the amount of the leaked fluid. Therefore, since variations of the pressure in the buffer space are small, so that the pressure may be considered to be substantially constant, or substantially the same as the initial introduction pressure, the leakage of the fluid from the work space into the buffer space becomes greater than that from the buffer space into the work space. According to repetition of such a phenomenon, the fluid is continually introduced from the work space into the buffer space, thereby increasing the pressure in the buffer space. The increase of the pressure in the buffer space causes a phenomenon in which the displacer 23 effects reciprocation while being continually displaced upward. As a result, a reciprocation position of the displacer 23 is deviated from the initial position, so that operational performance of the apparatus is lowered.

SUMMARY OF THE INVENTION

With the foregoing drawback of the prior art in view, it is an object of the present invention to prevent undesirable upward displacement of a displacer of a displacer apparatus of a Stirling cooler due to leakage of working fluid from a work space into a buffer space, by circulating the working fluid in the buffer space into the work space to compensate for the leakage of the fluid.

To achieve the above, there is provided according to a form of the present invention a displacer apparatus of a split Stirling cooler comprising a displacer body including a cylinder, a step portion defining a central bore and provided at a lower end of the cylinder, and a buffer space provided below the step portion; a displacer reciprocating within the cylinder in response to variations in pressure of incoming fluid in the cylinder, to thereby cause changes in volume of expansion and work spaces in the cylinder; a displacer rod having a recess formed in an outer periphery of a lower portion thereof, and connected to and extending downwardly from a lower surface of the displacer to be slidably disposed in the bore of the step portion; a through hole formed in the step portion to permit the work and buffer spaces to be in communication with each other; an actuating hole formed in the step portion to intersect the through hole; a centering rod having a through hole formed in its middle portion and capable of coming into registry with the through hole of the step portion, and placed in the actuating hole of the step portion with its forward tip being in contact with the recess of the displacer rod to effect forward and backward movements depending upon upward and downward movements of the displacer rod; and biasing means disposed rearwardly of the centering rod to apply a biasing force to the centering rod, thereby allowing the forward tip of the rod to be urged into contact with the displacer rod.

BRIEF DESCRIPTION OF THE DRAWINGS

In the accompanying drawings.

DETAILED DESCRIPTION OF THE PREFERRED EMBODIMENT

The invention will now be described in more detail, by way of example, with reference to the accompanying drawings.

Figure 1:
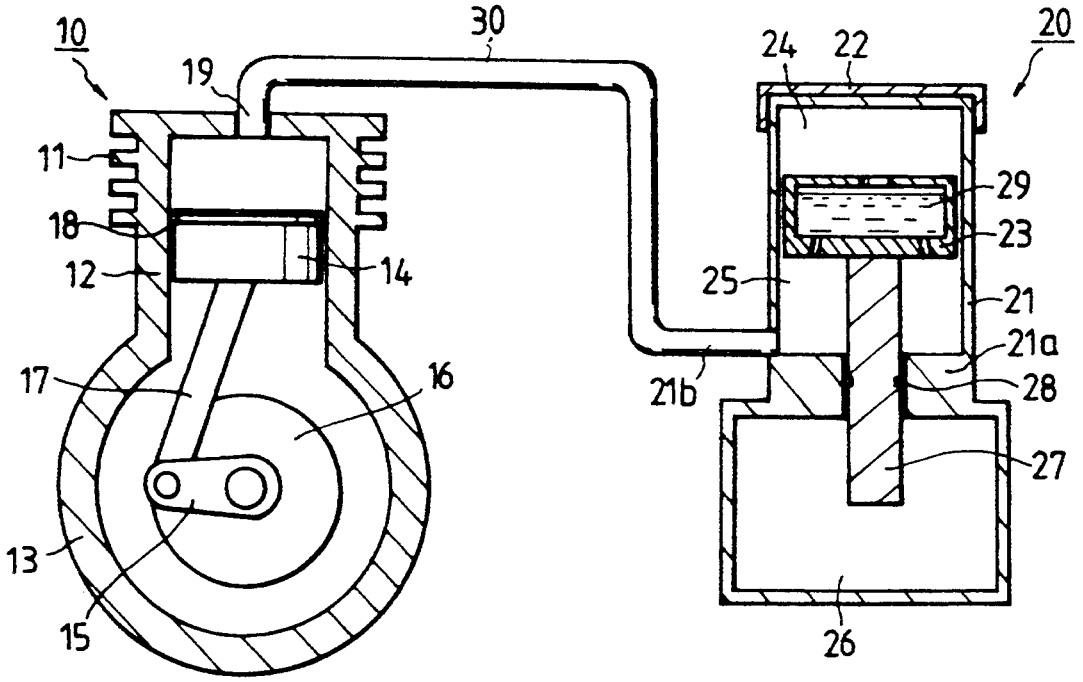
F I G. 1 PRIOR ART
FIG. 1 is a cross-sectional view showing a conventional Stirling cooler comprising a compressor and a prior art displacer apparatus.
Figure 2:
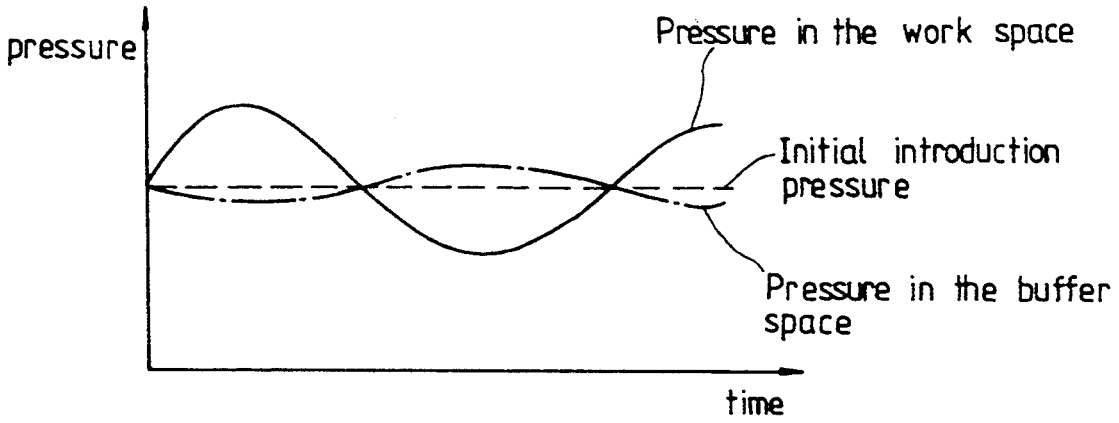
FIG. 2 is a graph showing a plot of variations in pressure of fluid in work and buffer spaces of the prior art displacer apparatus.
Figure 3:
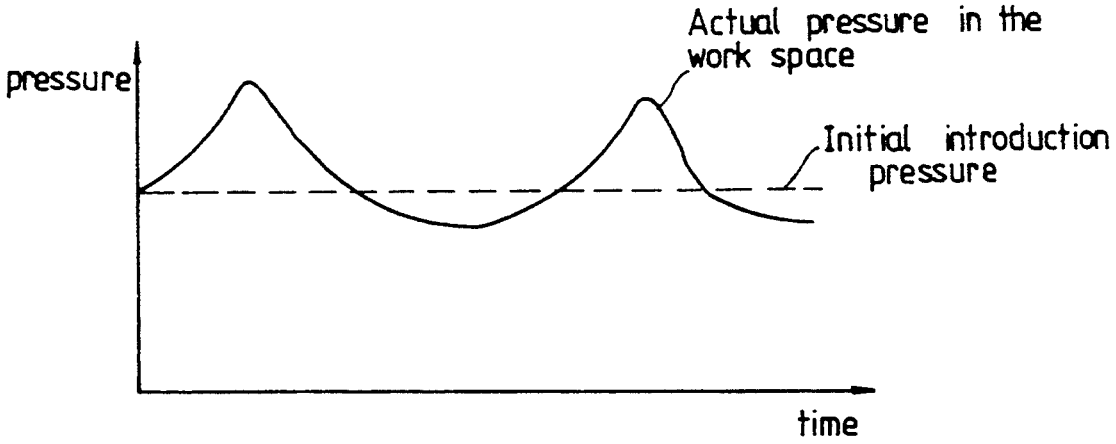
FIG. 3 is a graph showing a plot of variations in actual pressure of the fluid in the work space of the prior art displacer apparatus.
Figure 4:
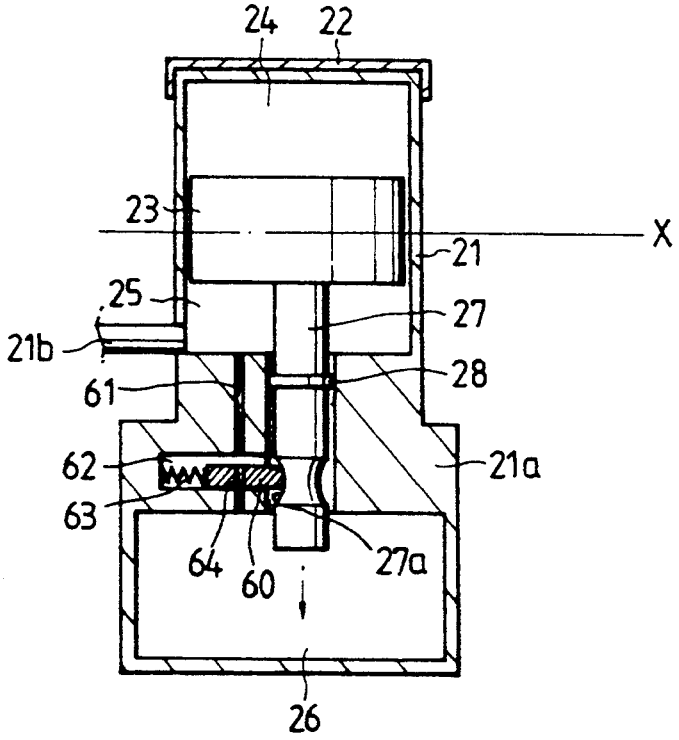
FIG. 4 is a cross-sectional view of a displacer apparatus according to the present invention, showing the state in which a centering device of the present invention allows flow communication between work and buffer spaces.
Figure 5:
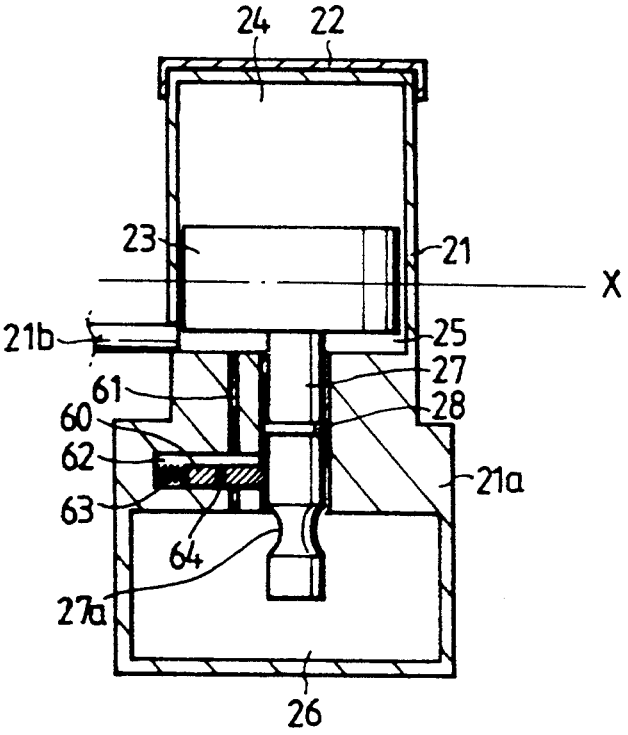
FIG. 5 is a cross-sectional view showing the state in which the centering device of the present invention intercepts flow of the working fluid between the work and buffer spaces.

A displacer apparatus of the Stirling cooler according to the present invention having the structure as shown in FIGS. 4 and 5 is identical in basic constitution and operation with the displacer apparatus of the prior art as set forth above. Therefore, their detailed description will be omitted herein to avoid the duplication of explanation, and throughout the following description elements similar to those of the prior art apparatus are indicated by similar reference numerals.

As shown in FIGS. 4 and 5, the displacer apparatus according to the present invention comprises a displacer body including a cylinder 21, a step portion 21*a* defining a central bore of a reduced diameter and formed integrally with a lower end of the cylinder 21, and a buffer space 26 provided below the step portion 21*a;* and a displacer 23 slidably mounted within the cylinder 21 and dividing the interior of the cylinder into an expansion space 24 and a work space 25. The step portion 21*a* has a through hole 61 formed therein to allow communication between the work space 25 and the buffer space 25, and an actuating hole 62 formed therein perpendicularly to the through hole 61 and be in communication with the through hole. Thus, the through hole 61 and the actuating hole 62 cross at right angles with each other. One end of the actuating hole 62 is open to the central bore of the step portion 21*a,* through which a displacer rod 27 connected to the lower side of the displacer 23 is extended downwardly.

Further, a centering rod 60 having a rectangular cross-sectional configuration is movably disposed in the actuating hole 62. The centering rod 60 has a through hole 64 formed in its middle portion and capable of coming into registry with the through hole 61 of the step portion 21*a.* Although the centering rod 60 may be circular or any other suitable shapes in cross section, in this embodiment, the centering rod is preferably of a rectangular hexahedral shape such that when place in the actuating hole 62, it can be kept in the posture in which the through hole 64 formed therein is capable of coming into registry with the through hole 61 of the step portion 21*a.* Similarly, the actuating hole 62 is preferably rectangular in cross section.

Further, the centering rod 60 has at its forward end a tip of a generally conical shape or a rounded tip, and the displacer rod 27 has a recess 27*a* of a generally semi-spherical shape which is formed in the outer periphery of the lower portion of the rod and with which the forward tip of the centering rod is brought into contact.

Biasing means such as a coil spring 63 is disposed rearwardly of the centering rod 60 in the actuating hole 62 to apply a biasing force to the centering rod. Therefore, when the centering rod is biased be the spring to urge the forward tip thereof into contact with the recess 27*a* of the displacer rod 27 so that the through hole 64 of the centering rod 60 is in alignment with the through hole 61 of the step portion 21*a,* as shown in FIG. 4, the centering rod serves to open a passage between the work and buffer spaces. On the other hand, when the through holes 64, 61 come out of registry with each other, as shown in FIG. 5, the centering rod serves to close the passage.

The forward and backward movements of the centering rod 60 in the actuating hole 62 are effected by the upward and downward movements of the displacer rod 27 depending upon variations in pressure of the working fluid in the work space 25. More specifically, when the displacer rod 27 is moved upward to he position where the recess 27*a* of the displacer rod is in alignment with the actuating hole 62 of the step portion 21*a*, the centering rod 60 movably disposed in the actuating hole 62 is advanced by the biasing force of the spring 63 so that the forward tip of the centering rod is brought into contact with the recess 27*a* of the displacer rod, as shown in FIG. 4. At this position, the through hole 64 of the centering rod 60 is aligned with the through hole 61 of the step portion 21*a* the open the passage between the work and buffer spaces 25, 26, thereby allowing flow of the working fluid therethrough.

In case that the displacer rod 27 is move downward form such a position, as the forward tip of the centering rod 60 gets out of the recess 27*a* of the displacer rod, the centering rod is moved backwardly against the biasing force of the spring 63 and brought into contact with a cylindrical portion of displacer rod above the recess, as shown in FIG. 5. As result, the through hole 64 of the centering rod is out of alignment with the through hole 61 of the step portion 21*a*, so that the flow communication between the work and buffer spaces is blocked.

In other words, when the displacer 23 is at a reference point "X" of the reciprocation thereof, as shown in FIG. 4, the through hole 64 of the centering rod 60 is in alignment with the through hole 61 of the step portion 21*a* so that the working fluid can flow between the work and buffer spaces 25, 26. At this point, the pressure in the work space becomes equal to that in the buffer space so that the pressure of the working fluid is maintained in the same condition as the initial introduction condition. This causes prevention of a phenomenon in which the displaced is gradually displaced upward according to an increase of pressure in the buffer space due to leakage of the working fluid from the work space into the buffer space during operation of the displacer apparatus.

From the foregoing it will be appreciated that the present invention allows the displacer to be actuated always at a constant position by passing the working fluid between the work and buffer spaces in response to actuation of the displacer, to thereby compensate for variations in pressure of the fluid in the buffer space due to the leakage of the working fluid, so that performance of the apparatus may be greatly enhanced.

While the invention has been shown and described with particular reference to a preferred embodiment thereof, it will be understood that variations and modifications in form and detail may be made therein without departing from the spirit and scope of the invention as defined in the appended claims.

What is claimed is:

1. A displacer apparatus of a split Stirling cooler comprising:

a displacer body including a cylinder, a step portion defining a central bore and provided at a lower end of said cylinder, and a buffer space provided below said step portion;

a displacer reciprocating within said cylinder in response to variations in pressure of incoming fluid in said cylinder, to thereby cause changes in volume of expansion and work spaces in said cylinder;

a displacer rod having a recess formed in an outer periphery of a lower portion thereof, and connected to and extending downwardly from a lower surface of said displacer to be slidably disposed in said bore of said step portion;

a through hole formed in said step portion to permit said work and buffer spaces to be in communication with each other;

an actuating hole formed in said step portion to intersect said through hole;

a centering rod having a through hole formed in its middle portion and capable of coming into registry with said through hole of said step portion, and placed in said actuating hole of said step portion with its forward tip being in contact with said recess of said displacer rod to effect forward and backward movements depending upon upward and downward movements of said displacer rod; and biasing means disposed rearwardly of said centering rod to apply a biasing force to said centering rod, thereby allowing said forward tip of said rod to be urged into contact with said displacer rod.

2. A displacer apparatus of a split Stirling cooler as claimed in claim 1, in which each of said actuating hole and said centering rod has a rectangular cross-sectional configuration.

3. A displacer apparatus of a split Stirling cooler as claimed in claim 2, in which said forward tip of said centering rod is of a generally conical shape, and said recess of said displacer rod brought into contact with said tip of said centering rod is of a generally semispherical shape cross section.

4. A displacer apparatus of a split Stirling cooler as claimed in claim 1, in which said biasing means comprises a coil spring.

* * * * *